US006545432B2

(12) United States Patent
Konopka

(10) Patent No.: US 6,545,432 B2
(45) Date of Patent: Apr. 8, 2003

(54) BALLAST WITH FAST-RESPONDING LAMP-OUT DETECTION CIRCUIT

(75) Inventor: John G. Konopka, Deer Park, IL (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/923,650

(22) Filed: Aug. 6, 2001

(65) Prior Publication Data

US 2003/0025464 A1 Feb. 6, 2003

(51) Int. Cl.[7] ..... G05F 1/00

(52) U.S. Cl. ..... 315/291; 315/307; 315/224; 315/DIG. 7

(58) Field of Search ..... 315/291, 307, 315/224, 225, DIG. 7, 209 R

(56) References Cited

U.S. PATENT DOCUMENTS 5,528,147 A 6/1996 Konopka ..... 324/403
5,767,631 A * 6/1998 Konopka et al. ..... 315/127
5,770,925 A * 6/1998 Konopka et al. ..... 315/127
5,869,937 A 2/1999 Konopka ..... 315/291
5,969,483 A * 10/1999 Li et al. ..... 315/224
5,982,109 A 11/1999 Konopka et al. ..... 315/209 R
5,994,847 A * 11/1999 Konopka ..... 315/209 R

* cited by examiner

*Primary Examiner*—Don Wong
*Assistant Examiner*—Tuyet T. Vo
(74) *Attorney, Agent, or Firm*—Kenneth D. Labudda

(57) ABSTRACT

A ballast (10) for powering a gas discharge lamp includes a lamp-out detection circuit (300) that quickly responds to a lamp-out condition. Lamp-out detection circuit (300) receives a portion of the lamp current and provides a detection voltage. The detection voltage remains at a first average level while the lamp is conducting current in a normal manner, but quickly decreases below a second level if the lamp ceases to conduct current. In a preferred embodiment, ballast (10) includes an inverter (100) and a resonant circuit (210,220) that are normally operated at a high frequency. The detection voltage is coupled to an enable input (112) of an inverter drive circuit (110), and the inverter (100) is either shut off or operated in a low-power mode within less than ten high frequency cycles after occurrence of a lamp-out condition.

20 Claims, 4 Drawing Sheets

BALLAST WITH FAST-RESPONDING LAMP-OUT DETECTION CIRCUIT

FIELD OF THE INVENTION

The present invention relates to the general subject of circuits for powering discharge lamps. More particularly, the present invention relates to a ballast that includes a circuit for quickly detecting a lamp-out condition.

BACKGROUND OF THE INVENTION

Electronic ballasts that include an inverter and a series resonant type output circuit generally require some form of protection circuitry in order to prevent excessive power dissipation and/or damage due to the high voltages and currents that tend to result when a lamp fails or is removed. It is especially important that the protection circuitry quickly detect lamp failure or removal so that appropriate control action may be taken (e.g., shutting down the inverter) before the voltages and currents in the inverter and resonant circuit reach undesirably high levels.

There are many types of protection circuits in the prior art. These protection circuits may be classified according to the signals that are monitored in order to detect a lamp fault condition. In one group are "supply-side" approaches that are concerned with monitoring signals in the inverter portion of the ballast, such as the current through the inverter switches which is usually monitored via a current-sensing resistor placed in series with one of the inverter switches. Such circuits are most readily implemented in ballasts with driven, as opposed to self-oscillating, inverters. In another group are "load side" approaches that focus on signals at the ballast output and the lamp(s), such as the current that flows through the lamp(s) or the voltage that appears across a direct current (DC) blocking capacitor in series with the lamp(s). The present invention is intended as an alternative to existing approaches within this latter lass of protection circuits.

One known "load side" approach employs either a current transformer or current-sensing resistor that is placed in series with the lamp(s) in order to directly monitor the lamp current. However, both of these components have significant drawbacks. A current transformer is quite costly in terms of both material and ballast manufacturability. A current sensing resistor, while materially inexpensive, is significantly dissipative and thus undesirable from the standpoint of ballast energy efficiency.

Another known "load side" approach monitors the voltage across a direct current (DC) blocking capacitor in series with the lamp load. As illustrated in FIG. 1, a typical realization of this approach utilizes a resistor voltage divider arrangement ($R_1$, $R_2$) connected in parallel with the DC blocking capacitor ($C_B$). The operation and limitations of this approach are discussed with reference to FIGS. 1 and 2 as follows.

During normal operation, when the lamp load is conducting current in a normal manner, the voltage across $C_B$ has an average value of $V_{DC}/2$ (e.g., 225 volts). $V_{OUT}$ is a highly scaled-down version of the voltage across $C_B$, and is typically set to have an average value that is on the order of several volts (e.g., 5 volts) when the lamp load is operating normally. For the sake of later comparison, it is assumed that the inverter drive circuit is configured to turn the inverter off (or take some other type of protective action) when $V_{OUT}$ falls below a predetermined value (e.g., 2.5 volts).

If the lamp load is removed or fails to conduct current, $C_B$ is deprived of charging current and begins to discharge into $R_1$ and $R_2$. Correspondingly, the voltage across $C_B$, and hence $V_{OUT}$, decreases. Once $V_{OUT}$ falls below a predetermined level (e.g., 2.5 volts), the inverter drive circuit senses that there is a lamp fault and takes appropriate control action (e.g., shuts down the inverter) in order to limit power dissipation and prevent damage to the ballast.

FIG. 2 is an approximate plot of $V_{OUT}$ for when the circuit of FIG. 1 is realized with the following component and parameter values: $V_{DC}$=450 volts, $C_B$=0.1 microfarad, $I_{LAMP}$=180 milliamperes (rms), $R_1$=220 kilohms, $R_2$=5.1 kilohms. During the period $\mathbf{0}<t<t_1$, the lamp load is operating normally and the voltage across $C_B$ is at its normal value of $V_{DC}/2$=225 volts. Correspondingly, $V_{OUT}$ has an average (DC) value of approximately 5 volts; $V_{OUT}$ also includes a small amount of high frequency ripple. Upon occurrence of a lamp-out condition (i.e., removal of the lamp or failure of the lamp to conduct current) at time $t_1$, the voltage across $C_B$ begins to decrease as a rate determined by the capacitance of $C_B$ and the sum of the resistances of $R_1$ and $R_2$. After about 16 milliseconds, at $t=t_2$, $V_{OUT}$ reaches about half (i.e., 2.5 volts) of its normal operating value (i.e., 5 volts), at which point the inverter drive circuit shuts down the inverter or shifts the inverter operating frequency to a value that is far enough removed from the natural resonant frequency of $L_R$ and $C_R$ so as to limit power dissipation and prevent undesirably high voltages and currents in the ballast.

In a real ballast, the inverter is normally operated at a frequency that is at or near the natural resonant frequency of $L_R$ and $C_R$; for a number of practical reasons, this frequency is preferably set to be greater than 20,000 hertz. With such a high operating frequency, it does not take very long for the voltages and currents in the inverter and resonant circuit to reach damaging levels after a lamp fault occurs. For example, with an operating (and resonant) frequency of 40,000 hertz, the voltages and currents in the ballast will have reached undesirably levels within as few as 4–5 cycles (e.g., 100–125 microseconds) or so after occurrence of a lamp fault. Because 125 microseconds is far less than the 16 milliseconds that it takes for $V_{OUT}$ to fall to a level that indicates a lamp-out condition, this approach is not nearly fast enough to serve as a reliable protection circuit.

In the prior art circuit of FIG. 1, the time that it takes for $V_{OUT}$ to decrease by a given amount following a lamp-out condition is governed by $C_B$, $R_1$, and $R_2$. Although the time may be shortened by decreasing the capacitance of $C_B$ and/or the sum of the resistances of $R_1$ and $R_2$, there are other constraints that render this strategy impractical. First, because the minimum required capacitance of $C_B$ is dictated by the magnitude of $I_{LAMP}$ and other design considerations, a reduction in the capacitance of $C_B$ is generally not an option. Second, in order to prevent life-shortening migration effects in the lamp(s) due to the presence of a direct current (DC) component in $I_{LAMP}$, the sum of the resistances of $R_1$ and $R_2$ must be large enough to limit the DC component of $I_{LAMP}$ to no more than one milliampere during normal operation of the lamp load. With R1+R2 set to 225.1 kilohms and with $V_{DC}$ set to 450 volts (as in the present example), the DC component of $I_{LAMP}$ is approximately one milliampere. Any further reduction in $R_1+R_2$ would cause the DC component to exceed one milliampere, which would be unacceptable. Thus, there is no apparent way in which to shorten the response time of the approach of FIG. 1 without violating other important design constraints.

What is needed, therefore, is a ballast with a compact and cost-effective arrangement for quickly detecting and responding to lamp removal or failure, but without introducing excessive DC current through the lamps. A ballast with these features would represent a significant advance over the prior art.

DETAILED DESCRIPTION OF THE PREFERRED EMBODIMENTS

Figure 3:
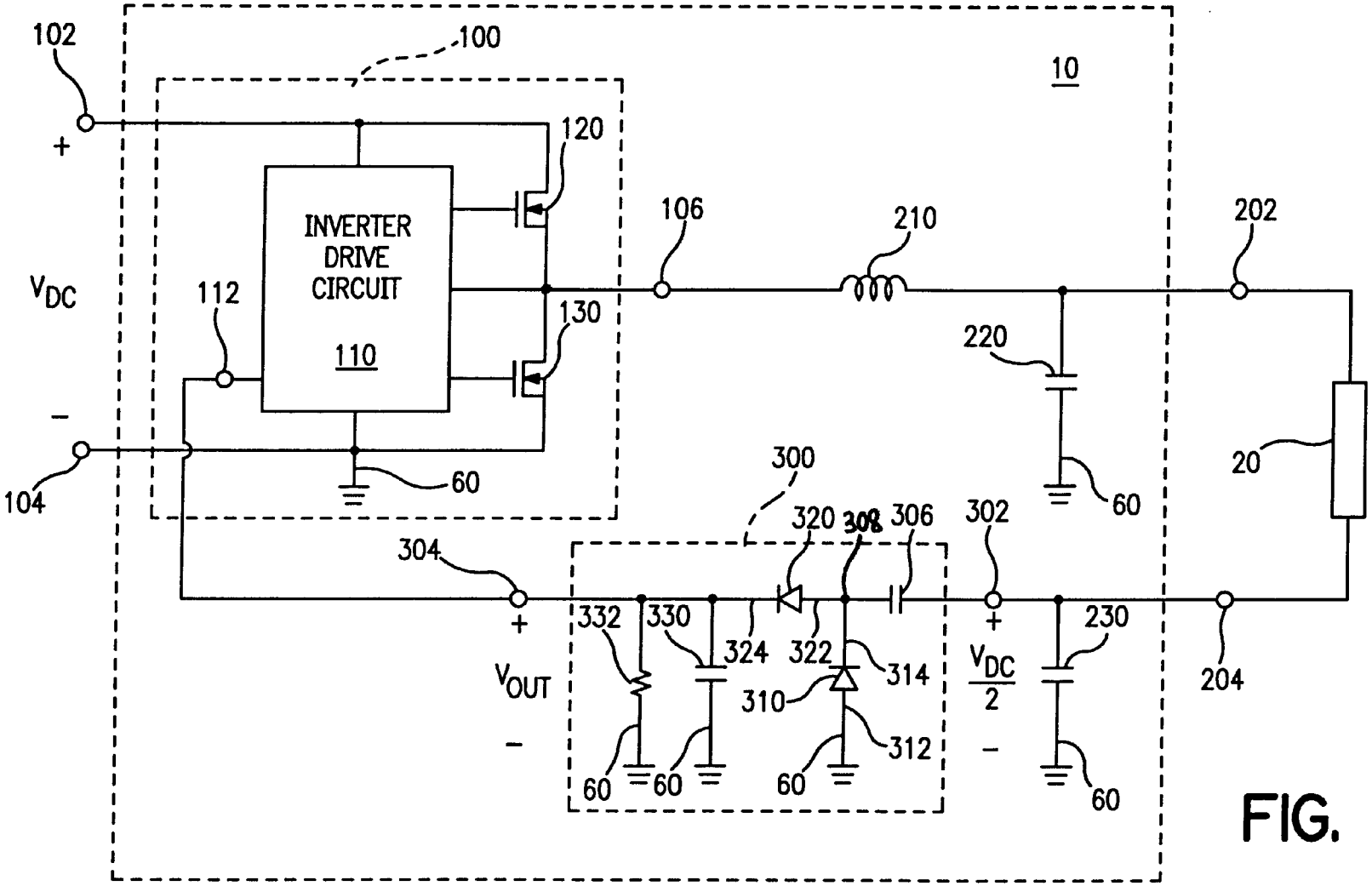
FIG. 3 describes a ballast with a lamp-out detection circuit, in accordance with a preferred embodiment of the present invention.

FIG. 3 describes a ballast 10 for powering a gas discharge lamp load 20. Ballast 10 comprises an inverter 100, first and second output connections 202,204, a resonant circuit 210, 220, a direct current (DC) blocking capacitor 230, and a lamp-out detection circuit 300. Lamp load 20 includes one or more gas discharge lamps.

During operation, inverter 100 provides an alternating output voltage at an inverter output 106. The alternating output voltage provided by inverter 100 has an operating frequency (preferably, 20 kilohertz or greater) and a corresponding period (e.g., 50 microseconds or less). First output connection 202 is adapted for connection to a first end of lamp load 20, and second output connection 204 is adapted for connection to a second end of lamp load 20. Resonant circuit 210,220 is coupled between inverter output 106 and first output connection 202. Resonant circuit 210,220 has a natural resonant frequency that is at or near the operating frequency of the inverter output voltage. Preferably, the resonant circuit includes a resonant inductor 210 and a resonant capacitor 220 configured as a series resonant circuit. Resonant inductor 210 is coupled between inverter output 106 and first output connection 202. Resonant capacitor 220 is coupled between first output connection 202 and circuit ground 60. When inverter 100 is operated at or near resonance, inductor 210 and capacitor 220 provide a high voltage for igniting the lamp(s), as well as a magnitude-limited current for operating the lamp(s). Direct current blocking capacitor 230 is coupled between second output connection 204 and circuit ground 60.

Figure 1:
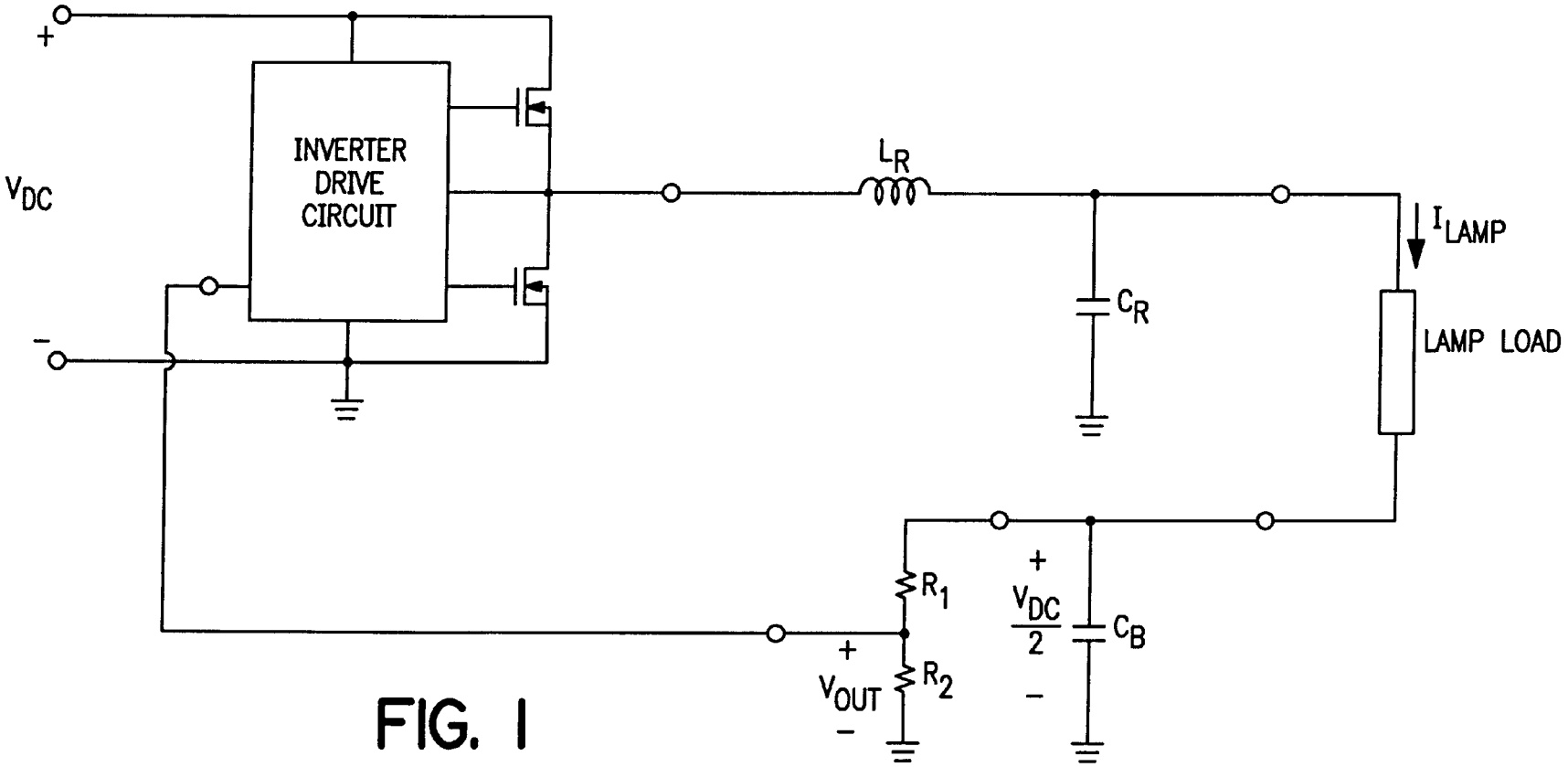
FIG. 1 PRIOR ART
FIG. 1 describes a ballast with a lamp-out detection circuit, in accordance with the prior art.
Figure 2:
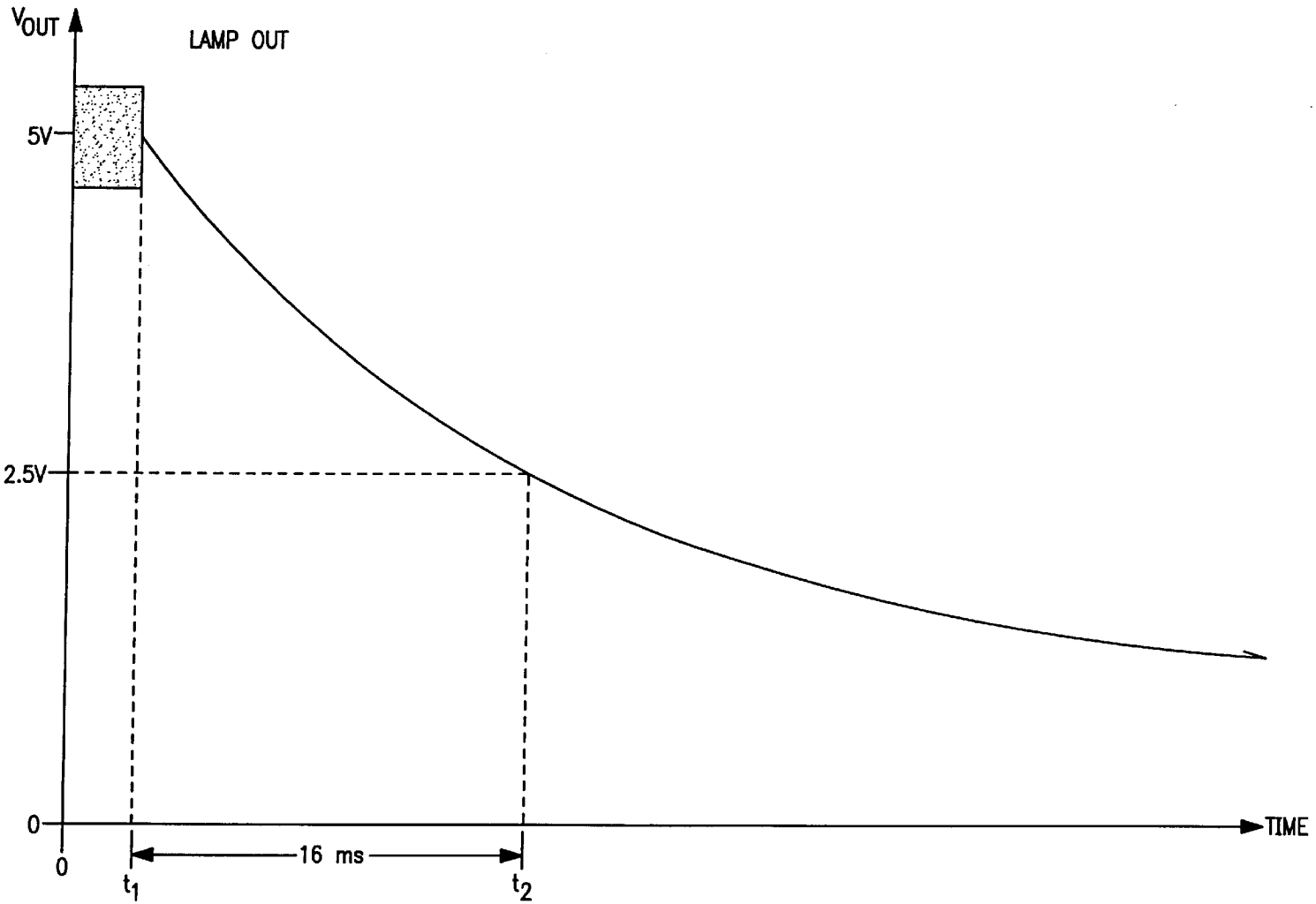
FIG. 2 PRIOR ART
FIG. 2 describes the operation of the lamp-out detection circuit in the arrangement of FIG. 1, in accordance with the prior art.

Lamp-out detection circuit 300 includes a detection input 302 and a detection output 304. Detection input 302 is electrically coupled to second output connection 204. During operation, when current is flowing through lamp load 20, lamp-out detection circuit 300 receives a small portion of the lamp current via detection input 302 and develops a detection voltage, $V_{OUT}$, at detection output 304. $V_{OUT}$ remains at a first average level (e.g., 5 volts) while lamp load 20 is conducting current in a substantially normal manner. In response to a lamp-out condition wherein the lamp load ceases to conduct current, $V_{OUT}$ decreases from the first average level (e.g., 5 volts) to below a second level that is substantially less than the first average level (e.g., 2.5 volts) within a response time that is less than ten periods of the inverter output voltage. As an example, for an inverter operating frequency of 40 kilohertz (i.e., one period=25 microseconds), $V_{OUT}$ will fall below 2.5 volts within less than 250 microseconds, which more than fifty times faster than the prior art approach described in FIGS. 1 and 2. Preferably, lamp-out detection circuit 300 can be designed so that $V_{OUT}$ falls below 2.5 volts within an even shorter time, such as 100 microseconds or less. Additionally, the portion of the lamp current that flows into detection input 302 when lamp load 20 is conducting current in a substantially normal manner has an average value that is substantially less than one milliampere. Thus, lamp-out detection circuit 300 provides much faster lamp fault detection than the prior art approach of FIG. 1, and does so without introducing an excessively large DC component in the lamp current.

Preferably, in order to provide a control signal with useful resolution, the second level for $V_{OUT}$ is set at least twenty percent lower than the first average level for $V_{OUT}$. That is, if the first average level is set at 5 volts, then the second level is preferably set at 4 volts or lower. For clarity and ease of comparison with the prior art, the description herein refers to the second level being set at 2.5 volts.

As described in FIG. 3, in a preferred embodiment of the present invention, lamp-out detection circuit 300 includes a first capacitor 306, a first diode 310, a second diode 320, a second capacitor 330, and a resistor 332. First capacitor 306 is coupled between detection input 302 and a first node 308. First diode 310 has an anode 312 coupled to circuit ground 60 and a cathode 314 coupled to first node 308. Second diode 320 has an anode 322 coupled to first node 308 and a cathode 324 coupled to detection output 304. Second capacitor 330 and resistor 332 are each coupled between detection output 304 and circuit ground 60.

In a preferred embodiment, inverter 100 includes input terminals 102,104, an inverter output 106, at least one inverter switch coupled to inverter output 106, and an inverter drive circuit 110. Input terminals 102,104 are adapted to receive a source of substantially direct current (DC) voltage, $V_{DC}$. $V_{DC}$ is preferably on the order of at least several hundred volts (e.g., 450 volts) and may be supplied via a full-wave rectifier and boost converter arrangement coupled to a conventional source of 60 hertz alternating current (AC), such as 120 volts rms or 277 volts rms. As described in FIG. 4, inverter 100 may be realized as a half-bridge type inverter that includes two series-connected transistors 120,130 that are switched on and off in a substantially complementary manner by an inverter drive circuit 110 so as to provide a substantially squarewave voltage at inverter output 106. Inverter drive circuit 110 preferably includes an enable input 112 coupled to detection output 304.

In a preferred embodiment, drive circuit 110 allows inverter 100 to continue to operate in a normal manner (i.e., turns transistors 120,130 on and off in a substantially complementary manner and at a switching frequency at or near the natural resonant frequency of inductor 210 and capacitor 220) as long as the detection voltage, $V_{OUT}$, remains above the second level (e.g., 2.5 volts). In response to $V_{OUT}$ falling below the second level (e.g., 2.5 volts), drive circuit 110 either shuts the inverter off (i.e., entirely ceases switching of transistors 120,130) or operates the inverter in a low-power mode (i.e., at a switching frequency that is far away from, and preferably substantially greater than, the natural resonant frequency of inductor 210 and capacitor 220).

The detailed operation of lamp-out detection circuit 300 is now explained with reference to FIGS. 3 and 4 as follows.

During normal operation, capacitor 330 charges during the positive half cycles of the lamp current (i.e., when positive-going current flows out of output connection 202, through lamp load 20, and back into output connection 204) and partially discharges into resistor 332 during the negative half-cycles of the lamp current. More specifically, during the positive half-cycles, a small amount of current flows into detection input 302, through capacitor 306, through diode 320, and into capacitor 330 and resistor 332. The magnitude of the positive current that charges capacitor 330 determines the normal operating value of $V_{OUT}$, and is determined by the capacitance of capacitor 306, the resistance of resistor 332, and the operating frequency of inverter 100. A larger capacitance for capacitor 306 and/or a larger resistance for resistor 332 and/or a higher operating frequency increases the amount of charging current that flows into capacitor 332, and hence increases $V_{OUT}$. Conversely, the normal operating value of $V_{OUT}$ may be decreased by decreasing the capacitance of capacitor 306 and/or the resistance of resistor 332 and/or the operating frequency of inverter 100. During the negative half-cycles of the lamp current, a small amount of current flows up from circuit ground 60, through diode 310, through capacitor 306, and out of detection input 302. Significantly, because lamp-out detection circuit 300 draws both positive-going and negative-going current, it does not cause a significant DC component in the lamp current.

If lamp load 20 is suddenly removed or ceases to conduct current, charging current ceases to flow into detection input 302. Consequently, capacitor 330 ceases to be replenished and continuously discharges into resistor 332. $V_{OUT}$ thus decreases at a rate governed by the capacitance of capacitor 330 and the resistance of resistor 332. When $V_{OUT}$ falls below 2.5 volts, inverter driver circuit 110 either ceases switching of transistors 120,130 or shifts the switching frequency to a value (e.g., 100 kilohertz) that is well removed from the natural resonant frequency (e.g., 40 kilohertz) of inductor 210 and capacitor 220. In this way, lamp-out detection circuit 300 and inverter 100 quickly respond to a lamp-out condition and prevents the voltages and currents in inverter 100, inductor 210, and capacitor 220 from reaching destructive levels.

A prototype ballast configured substantially as shown in FIG. 3 was realized with the following component and parameter values:

VDC: 450 volts

Inverter operating frequency: 45 kilohertz

Inductor 210: 3.8 millihenries

Capacitor 220: 3.9 nanofarads

Figure 4:
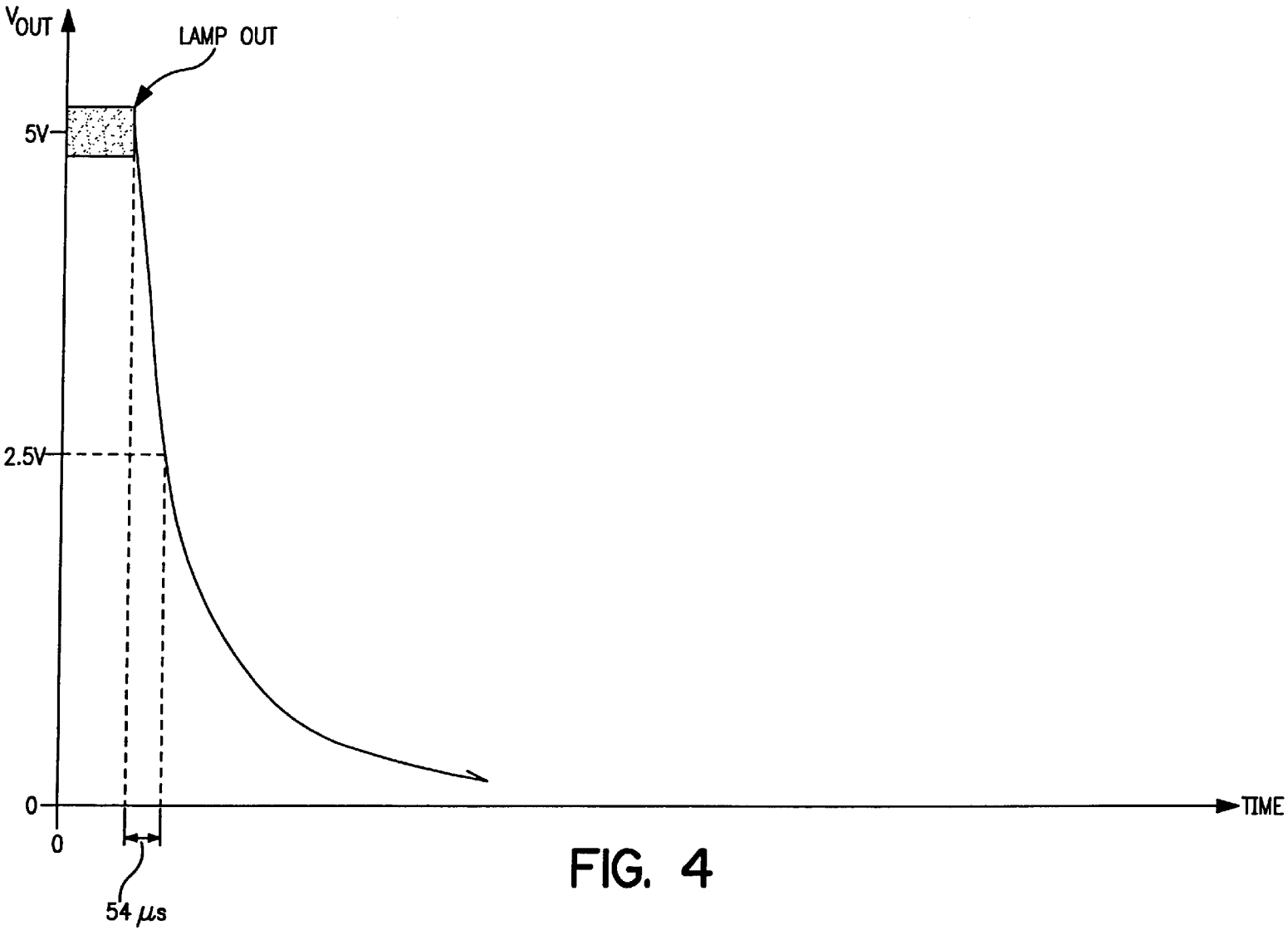
FIG. 4 describes the operation of the lamp-out detection circuit in the arrangement of FIG. 3, in accordance with a preferred embodiment of the present invention.

Lamp-out detection circuit 300:

- Capacitor 230: 0.1 microfarads, 250 volts
- Capacitor 306: 0.0047 microfarads, 250 volts
- Diodes 310,320: 1N4148
- Capacitor 330: 0.047 microfarads
- Resistor 332: 2.2 kilohms, ¼ watt As illustrated in FIG. 4, following a lamp-out condition, $V_{OUT}$ falls from an operating level of about 5 volts to a detection level of about 2.5 volts within about 54 microseconds, which is less than three high frequency cycles and thus fast enough to allow inverter drive circuit 110 to take appropriate action to prevent the voltages and currents in ballast 10 from building up to undesirably high levels.

Although the present invention has been described with reference to certain preferred embodiments, numerous modifications and variations can be made by those skilled in the art without departing from the novel spirit and scope of this invention. For example, although the preferred embodiment includes an arrangement wherein the output voltage, $V_{OUT}$, of lamp-out detection circuit 300 is coupled to an enable input of an inverter drive circuit, it should be appreciated that $V_{OUT}$ may be utilized with other types of inverters and ballast circuitry. For example, $V_{OUT}$ may be used to terminate inverter switching in a self-oscillating (as opposed to driven) type inverter. Alternatively, $V_{OUT}$ may be used to control a switch that is coupled to the resonant circuit; an example of this approach is described in the present inventor's copending U.S. patent application entitled "Ballast with Efficient Filament Preheating and Lamp Fault Protection" (filed on the same day and assigned to the same assignee as the present application), the disclosure of which is incorporated herein by reference. As still another example, if ballast 10 includes a rectifier and boost converter, lamp-out detection circuit 300 may be used to disable the boost converter (and thus reduce $V_{DC}$ to the peak of the AC line voltage) or to activate a switching arrangement that disconnects ballast 10 from the AC line when $V_{OUT}$ falls below a predetermined level.

What is claimed is:

1. A ballast for powering at least one gas discharge lamp, comprising:

an inverter, comprising:

input terminals for receiving a source of substantially direct current (DC) voltage;

an inverter output;

at least one inverter switch coupled to the inverter output;

an inverter drive circuit coupled to the inverter switch, the inverter drive circuit having an enable input and being operable to turn the inverter switch on and off in a periodic manner as long as the voltage at the enable input exceeds a predetermined value;

an output circuit, comprising:

a first output connection adapted for connection to a first end of the lamp;

a second output connection adapted for connection to a second end of the lamp;

a resonant inductor coupled between the inverter output and the first output connection;

a resonant capacitor coupled between the first output connection and circuit ground;

a direct current (DC) blocking capacitor coupled between the second output connection and circuit ground;

a lamp-out detection circuit coupled between the second output connection and the enable input of the inverter, comprising:

a detection input coupled to the second output connection;

a detection output coupled to the enable input of the inverter drive circuit;

a first capacitor coupled between the detection input and a first node;

a first diode having an anode coupled to circuit ground and a cathode coupled to the first node;

a second diode having an anode coupled to the first node and a cathode coupled to the detection output;

a second capacitor coupled between the detection output and circuit ground; and a resistor coupled between the detection output and circuit ground.

2. A ballast for powering a gas discharge lamp load, comprising:

an inverter having an inverter output and operable to provide an alternating inverter output voltage at the inverter output, the inverter output voltage having an operating frequency and a period;

first and second output connections, wherein the first output connection is adapted for connection to a first end of the lamp load, and the second output connection is adapted for connection to a second end of the lamp load;

a resonant circuit coupled between the inverter output and the first output connection, the resonant circuit having a natural resonant frequency at or near the operating frequency of the inverter output voltage;

a direct current (DC) blocking capacitor coupled between the second output connection and circuit ground;

a lamp-out detection circuit having a detection input and a detection output, wherein the detection input is electrically coupled to the second output connection, the lamp-out detection circuit being operable, in response to a current flowing through the lamp load, to receive a portion of the current via the detection input and to develop a detection voltage at the detection output, wherein:

(i) the detection voltage remains at a first average level while the lamp load is conducting current in a substantially normal manner;

(ii) in response to a lamp-out condition wherein the lamp load ceases to conduct current, the detection voltage decreases from the first average level to below a second level that is substantially less than the first average level within a response time that is less than ten periods of the inverter output voltage; and (iii) the portion of the lamp current that flows into the detection input when the lamp load is conducting current in a substantially normal manner has an average value that is substantially less than one milliampere.

3. The ballast of claim 1, wherein the first average level is about 5 volts, and the second level is about 2.5 volts.

4. The ballast of claim 1, wherein the lamp-out detection circuit further comprises:

a first capacitor coupled between the detection input and a first node;

a first diode having an anode coupled to circuit ground and a cathode coupled to the first node;

a second diode having an anode coupled to the first node and a cathode coupled to the detection output; and a second capacitor coupled between the detection output and circuit ground.

5. The ballast of claim 4, wherein the lamp-out detection circuit further comprises a resistor coupled between the detection output and circuit ground.

6. The ballast of claim 1, wherein the inverter includes a drive circuit, the drive circuit having an enable input coupled to the detection output of the lamp-out detection circuit, wherein the drive circuit is operable to:

(i) allow the inverter to continue to operate in a normal manner as long as the detection voltage remains above the second level; and (ii) shut the inverter off in response to the detection voltage falling below the second level.

7. The ballast of claim 6, wherein the lamp-out detection circuit further comprises:

a first capacitor coupled between the detection input and a first node;

a first diode having an anode coupled to circuit ground and a cathode coupled to the first node;

a second diode having an anode coupled to the first node and a cathode coupled to the detection output; and a second capacitor coupled between the detection output and circuit ground.

8. The ballast of claim 1, wherein the second level is at least twenty percent lower than the first average level.

9. The ballast of claim 8, wherein the detection voltage decreases from the first average level to below the second level within less than about two hundred fifty microseconds after the lamp load ceases to conduct current.

10. The ballast of claim 8, wherein the wherein the detection voltage decreases from the first average level to below the second level within less than about one hundred microseconds after the lamp load ceases to conduct current.

11. The ballast of claim 2, wherein the inverter includes a drive circuit, the drive circuit having an enable input coupled to the detection output of the lamp-out detection circuit, wherein the drive circuit is operable to:

(i) allow the inverter to continue to operate in a high-power mode as long as the detection voltage remains above the second level; and (ii) operate the inverter in a low-power mode in response to the detection voltage falling below the second level.

12. The ballast of claim 11, wherein the lamp-out detection circuit further comprises:

a first capacitor coupled between the detection input and a first node;

a first diode having an anode coupled to circuit ground and a cathode coupled to the first node;

a second diode having an anode coupled to the first node and a cathode coupled to the detection output; and a second capacitor coupled between the detection output and circuit ground.

13. The ballast of claim 11, wherein the low-power mode includes operating the inverter at a frequency substantially greater than the frequency at which the inverter is operated when in the high-power mode.

14. A ballast for powering at least one gas discharge lamp, comprising:

first and second output connections, wherein the first output connection is adapted for connection to a first end of the lamp, and the second output connection is adapted for connection to a second end of the lamp;

a direct current (DC) blocking capacitor coupled between the second output connection and circuit ground;

a lamp-out detection circuit, comprising:

a detection input coupled to the second output connection;

a detection output;

a first capacitor coupled between the detection input and a first node;

a first diode having an anode coupled to circuit ground and a cathode coupled to the first node;

a second diode having an anode coupled to the first node and a cathode coupled to the detection output; and a second capacitor coupled between the detection output and circuit ground.

15. The ballast of claim 14, wherein the lamp-out detection circuit further comprises a resistor coupled between the detection output and circuit ground.

16. The ballast of claim 14, wherein the portion of the lamp current that flows into the detection input when the lamp is conducting current in a substantially normal manner has an average value that is substantially less than one milliampere.

17. The ballast of claim 14, wherein:

the lamp-out detection circuit is operable, in response to a current flowing through the lamp, to receive a portion of the current via the detection input and to develop a detection voltage at the detection output; and in response to a lamp-out condition wherein the lamp load ceases to conduct current, the detection voltage decreases below a second level that is substantially less than the first average level within less than about two hundred fifty microseconds after the lamp ceases to conduct current.

18. The ballast of claim 17, wherein the second level is at least twenty percent less than the first average level.

19. The ballast of claim 17, wherein the first average level is about 5 volts, and the second level is about 2.5 volts.

20. The ballast of claim 17, further comprising an inverter, the inverter having a drive circuit, the drive circuit having an enable input coupled to the detection output of the lamp-out detection circuit, wherein the drive circuit is operable:

(i) to allow the inverter to continue to operate as long as the detection voltage remains above the second level; and (ii) shut the inverter off in response to the detection voltage falling below the second level.

* * * * *